US005816940A

United States Patent [19]

Hayashi et al.

[11] Patent Number: 5,816,940

[45] Date of Patent: Oct. 6, 1998

[54] WOUND GOLF BALL

[75] Inventors: Junji Hayashi; Hisashi Yamagishi, both of Chichibu, Japan

[73] Assignee: Bridgestone Sports Co., Ltd., Tokyo, Japan

[21] Appl. No.: 831,514

[22] Filed: Apr. 1, 1997

[30] Foreign Application Priority Data

Apr. 3, 1996 [JP] Japan ..... 8-106315

[51] Int. Cl.[6] ..... A63B 37/06; A63B 37/12

[52] U.S. Cl. ..... 473/359; 473/363; 473/365; 473/377

[58] Field of Search ..... 473/363, 378, 473/359, 365, 377

[56] References Cited

U.S. PATENT DOCUMENTS 5,542,663 8/1996 Kato et al. ..... 473/363

5,674,137 10/1997 Maruko et al. ..... 473/378

*Primary Examiner*—George J. Marlo

*Attorney, Agent, or Firm*—Sughrue, Mion, Zinn, Macpeak & Seas, PLLC

[57] ABSTRACT

A wound golf ball is constructed by winding thread rubber on a center ball and enclosing with a cover. The center ball consists of a center core having a diameter of 20–37 mm and experiencing a distortion of 1–5 mm under a load of 100 kg and an enclosure layer having a Shore D hardness of 33–54 and has a diameter of 33–38 mm. The center core comprises a rubber composition comprising a base rubber, a co-crossing linking agent and a peroxide and being free of an oily substance. The cover consists of an inner layer having a Shore D hardness of 55–68 and an outer layer having a Shore D hardness of 30–58, the inner layer being harder than the outer layer by at least 5 in Shore D hardness. The ball is not only improved in spin, control, and flight distance on driver and approach shots, but also gives pleasant hitting feel with click.

16 Claims, 1 Drawing Sheet

WOUND GOLF BALL

BACKGROUND OF THE INVENTION

1. Field of the Invention

This invention relates to a thread wound golf ball having improved spin, control, flight and feel.

2. Prior Art

As compared with two- and multi-piece solid golf balls having a solid core enclosed with one or more covers, wound golf balls are superior in hitting feel and controllability, but inferior in flight distance upon driver shots because of an increased spin rate.

In order to increase the flight distance of wound golf balls upon driver shots, attempts were made to suppress a spin rate as disclosed in JP-A 129072/1984 and 4104/1994. One exemplary wound golf ball has a center ball with a relatively large diameter.

Wound golf balls having a large diameter center ball are intended to increase the flight distance upon driver shots by suppressing spin rate. Since the center ball is relatively large, the hardness of the center ball has a substantial influence on ball performance. The hitting feel becomes hard or soft depending on whether the center ball is hard or soft. In either case, a pleasant hitting feel is not obtainable because of the lack of click. In addition, a satisfactory flight distance is not always obtainable since restitution is somewhat lost.

"Click" is the sensation imparted to the golfer together with sound when the ball is hit by a golf club. Too strong a click means poor hitting feel whereas the golfer sensing no click gets no reliable hitting feel. Pleasant hitting feel has to be accompanied by appropriate click.

The wound golf balls proposed in the prior art can achieve an increase of flight distance by suppressing spin susceptibility, but at the sacrifice of some of the benefits inherent to wound golf balls. They do not fully meet the demand of many golf players. It is thus desired to solve these problems.

SUMMARY OF THE INVENTION

An object of the invention is to provide a wound golf ball which is improved in spin, control, flight distance and hitting feel.

Regarding a wound golf ball comprising a center ball having thread rubber wound thereon and a cover enclosing the wound center ball, the inventors have found that by constructing a relatively large diameter center ball of the two layer structure consisting of a center core and an enclosure layer, constructing a cover of the two layer structure consisting of an inner layer and an outer layer, and adjusting the hardness of the respective layers so as to provide the ball with an optimum overall hardness distribution, the ball is improved in control and flight performance and given a soft pleasant hitting feel with appropriate click.

According to the invention, the center core is formed relatively hard to undergo a distortion of 1 to 5 mm under a constant load of 100 kg and has an outer diameter of up to 37 mm. The enclosure layer is formed relatively soft to have a Shore D hardness of up to 54. The center ball consisting of the center core and the enclosure layer is formed to a relatively large diameter of 33 to 38 mm. The cover inner layer is formed relatively hard to have a Shore D hardness of 55 to 68. The cover outer layer is formed relatively soft to have a Shore D hardness of 30 to 58, and the cover inner layer is formed harder than the cover outer layer by at least 5 in Shore D hardness. Then the relatively hard center core contributes to appropriate click while the relatively soft enclosure layer contributes to a soft hitting feel. The relatively large diameter center ball consisting of the center core and the enclosure layer is effective for suppressing a spin rate upon driver shots, achieving an increase of flight distance. Additionally, the relatively soft cover outer layer contributes to an improvement in control while the relatively hard cover inner layer contributes to an improvement in restitution. These functions and results are effectively achieved in good balance by setting the hardness of the center core, enclosure layer, cover outer layer and cover inner layer as defined above.

Therefore, the present invention provides a wound golf ball comprising a center ball having thread rubber wound thereon and a cover enclosing the wound center ball. The center ball consists of a center core having a diameter of up to 37 mm and experiencing a distortion of 1 to 5 mm under a constant load of 100 kg and a layer enclosing the center core and having a Shore D hardness of up to 54. The center ball has a diameter of 33 to 38 mm. The cover consists of an inner layer having a Shore D hardness of 55 to 68 and an outer layer having a Shore D hardness of 30 to 58. The cover inner layer is harder than the cover outer layer by at least 5 in Shore D hardness.

BRIEF DESCRIPTION OF THE DRAWINGS

These and further features of the present invention will be apparent with reference to the following description and drawings.

The sole FIGURE.

DETAILED DESCRIPTION OF THE INVENTION

Figure 1:
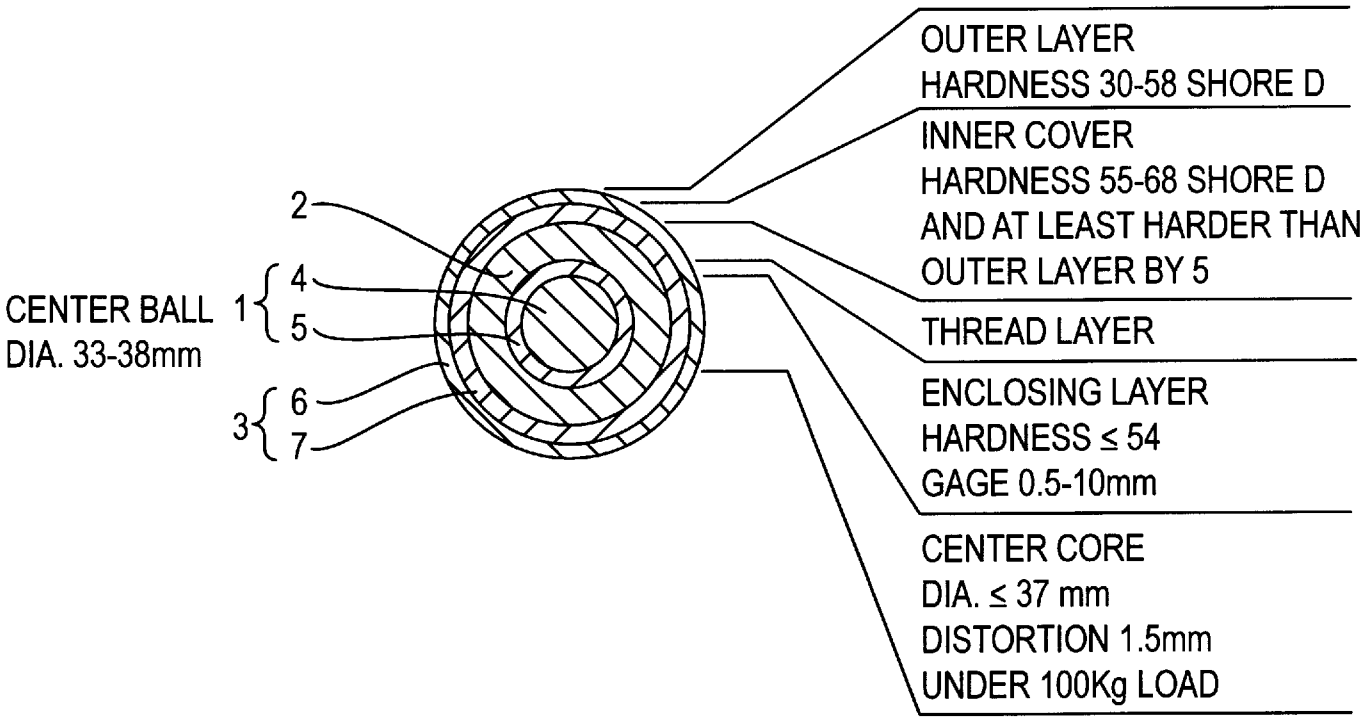
FIG. 1 is a schematic cross-sectional view of a wound golf ball according to one embodiment of the invention.

Referring to FIG. 1, a wound golf ball according to the invention is illustrated as comprising a center ball 1, a thread rubber layer 2 formed by winding thread rubber around the center ball, and a cover 3 enclosing the thread rubber layer 2. According to the invention, the center ball 1 is constructed as a two layer structure consisting of a center core 4 and an enclosure layer 5, and the cover 3 is constructed as a two layer structure consisting of an outer layer 6 and an inner layer 7.

The center core 4 of the center ball 1 is formed relatively hard so as to undergo a distortion of 1 to 5 mm, preferably 1.8 to 4.8 mm under a constant load of 100 kg so that the ball may give a hitting feel with click. The center core 4 should have an outer diameter of up to 37 mm, preferably 20 to 36 mm. If a center core undergoes a distortion of more than 5 mm under a load of 100 kg, hitting feel becomes too soft to produce click. A center core with a distortion of less than 1 mm is too hard and gives a hard hitting feel. A center core with a diameter of more than 37 mm gives a hard hitting feel and naturally requires the thread rubber layer 2 to be thinner, adversely affecting restitution. Click would be lost with a center core having a diameter of less than 20 mm.

The center core may be formed by conventional methods, for example, by heat compression molding of a well-known rubber composition comprising base rubber, a co-crosslinking agent, and a peroxide.

More particularly, the baser rubber may be polybutadiene rubber or a mixture of polybutadiene rubber and polyisoprene rubber as used in conventional solid centers. Use of 1,4-polybutadiene rubber containing more than 90% of cis-structure is recommended to provide high restitution. The co-crosslinking agents used herein include zinc and magnesium salts of unsaturated fatty acids such as methacrylic acid and acrylic acid and esters such as trimethylpropane trimethacrylate as in the prior art. Zinc acrylate is preferably used because high restitution is expectable. The amount of co-crosslinking agent blended is preferably 15 to 60 parts by weight per 100 parts by weight of the base rubber. Various peroxides may be used although dicumyl peroxide and a mixture of dicumyl peroxide and 1,1-bis(t-butylperoxy)-3,3,5-trimethylcyclohexane are preferred. The amount of peroxide blended is preferably 0.5 to 1.5 parts by weight per 100 parts by weight of the base rubber.

If desired, zinc oxide or barium sulfate may be blended in the rubber composition for adjusting the specific gravity. Blending of other additives such as anti-oxidants is acceptable. Since a center core is generally frozen in order to prevent the center core from deforming upon winding of thread rubber, oily substance is often added to the center core for facilitating freezing. The oily substance added, however, can reduce restitution and adversely affect the temperature dependency of restitution. In the practice of the invention, it is thus recommended to omit such oily substance.

The center ball 1 of the wound golf ball according to the invention is constructed by surrounding the center core 4 with the enclosure layer 5.

The enclosure layer 5 is formed on the spherical surface of the center core having a relatively high hardness and serves to maintain click given by the center core and provide the golf ball with a soft hitting feel. It is a relatively soft layer having a Shore D hardness of up to 54, preferably 33 to 53. If the enclosure layer has a Shore D hardness greater than 54, the center ball as a whole is too hard to impart a soft hitting feel. The gage of the enclosure layer 5 is generally 0.5 to 10 mm, especially 0.5 to 7 mm although it may be appropriately selected in accordance with the hardness of the enclosure layer itself and the outer diameter of the center core 4. An enclosure layer having a gage of more than 10 mm naturally requires the center core to be reduced in diameter, with a possibility of losing click. An enclosure layer having a gage of less than 0.5 mm would not exert its own function of avoiding a hard hitting feel.

The enclosure layer 5 may be formed by injection molding a well-known thermoplastic elastomer around the center core 4. Any thermoplastic elastomer may be used insofar as it cures into a layer having a hardness in the above-defined range. Use may be made of polyester thermoplastic elastomers, polyamide thermoplastic elastomers, and ionomer resins. For example, there are available ionomer resins such as Hytrel 4047, 4767 and 8122 (Toray-duPont K.K.), Surlyn (E. I. duPont), and Himilan (Mitsui-duPont Polychemical K.K.) and polyamide thermoplastic elastomers such as Pebax (Toray K.K.). Particularly when the cover is formed by heat compression molding to be described later, the heat can cause the enclosure layer to be melted to lose resilience. It is then recommended for the enclosure layer to use a resin having a higher melting point than the heating temperature.

The center ball 1 having the center core 4 enclosed with the enclosure layer 5 should have an outer diameter of 33 to 38 mm, preferably 34 to 37 mm in order to appropriately reduce a spin rate to increase a flight distance. A center ball having an outer diameter of more than 38 mm naturally requires the resilient thread rubber layer 2 to be thin, inviting a reduction of flight distance. A center ball having an outer diameter of less than 33 mm is ineffective for reducing a spin rate, failing to prevent sharp rise and shortage of flight.

Next, the cover 3 of the wound golf ball according to the invention is formed as a two layer structure consisting of the radially outer layer 6 and the radially inner layer 7. The respective layers 6 and 7 may be formed of a composition comprising a base resin well known as a cover stock, for example, ionomer resins, polyurethane elastomers, and balata rubber and optionally, commonly used amounts of a pigment such as titanium white and a dispersant such as magnesium stearate. The outer layer is formed to a low hardness and the inner layer is formed to a higher hardness than the outer layer.

More specifically, the cover outer layer 6 is formed as a relatively soft layer having a Shore D hardness of 30 to 58, preferably 35 to 55, thereby increasing a spin rate on approach shots to improve controllability. The cover outer layer 6 may be formed of any desired material insofar as the above-defined hardness is obtained. For example, ionomer resins such as Himilan 8120, 8220 and 8320 (Mitsui-duPont Polychemical K.K.) and a mixture thereof, polyurethane elastomers such as Pandex (Dai-Nihon Ink Chemical Industry K.K.), and balata rubber may be used.

Although the gage of the outer layer 6 is not particularly limited, it is preferably 0.5 to 2 mm, especially 0.7 to 1.5 mm. An outer layer thinner than 0.5 mm would be ineffective for improving controllability whereas a cover having an outer cover of thicker than 2 mm becomes too soft as a whole, probably inviting a restitution decline and diminution of click.

The cover inner layer 7 is formed as a relatively hard layer having a Shore D hardness of 55 to 68, preferably 60 to 66, thereby ensuring sufficient restitution. Any desired resin may be used insofar as it cures into a layer having a hardness in the above-defined range. Illustrative examples include ionomer resins such as Himilan 1554, 1555, 1601, 1702, 1705, and 1706 (trade name, manufactured by Mitsui-duPont Polychemical K.K.) and mixtures thereof as well as polyurethane elastomers such as Pandex (trade name, manufactured by Dai-Nihon Ink Chemical Industry K.K.).

Although the gage of the inner layer 7 is not particularly limited, it is preferably 0.5 to 2 mm, especially 0.6 to 1.5 mm. An inner layer of thinner than 0.5 mm would be ineffective for providing sufficient restitution with a decline of flight distance. A cover having an inner cover 7 thicker than 2 mm becomes too hard as a whole, probably leading to less controllability and poor hitting feel.

The hardness difference between the inner layer 7 and the outer layer 6 of the cover should be at least 5, especially at least 8 in Shore D hardness. With a hardness difference of less than 5, it would become difficult for the outer and inner layers to individually exert their own functions.

As mentioned above, the cover 3 of the golf ball according to the invention is of the two layer structure consisting of the outer and inner layers 6 and 7 wherein the outer layer cooperates with the inner layer to ensure satisfactory rebound. Especially on approach shots, the outer layer cooperates with the inner layer to produce optimum spin, offering the advantage of ease of control. Although the total gage of the cover 3 is not particularly limited, it is preferably 1 to 3.5 mm, especially 1.5 to 3 mm.

It is now briefly described how to prepare the golf ball of the present invention basically comprising the center ball 1, the thread rubber layer 2, and the cover 3. When thread rubber is wound around the center ball 1 to form the thread rubber layer 2 thereon to construct a wound core, thread rubber of a known type and a well-known winding method may be used. The thread rubber layer 2 preferably has a gage of 1 to 4 mm, especially 1.5 to 3.8 mm. The wound core composed of the center ball 1 and the thread rubber layer 2 is then enclosed with the cover 3 of two layer structure by well-known processes, for example, by repeating twice the step of directly injection molding a cover stock on the wound core. Alternatively, the cover may be applied by preforming hemispherical half cups from cover stocks, lapping two pairs of half cups, encasing the wound core in the half cups, and effecting heat pressure molding at 110° to 160° C. for 2 to 10 minutes.

The wound golf ball of the invention may be formed in its cover surface with dimples in a conventional pattern by a well-known method. The ball should have a diameter of not less than 42.67 mm and a weight of not greater than 45.93 grams in accordance with the Rules of Golf.

EXAMPLE

Examples of the present invention are given below together with Comparative Examples by way of illustration and not by way of limitation.

Examples 1–7 and Comparative Examples 1–4

A center ball was prepared by milling a rubber composition of the formulation shown in Table 1 in a roll mill and pressure molding it at 155° C. for 15 minutes to form a center core. A resin as shown in Table 1 was then injection molded around the center core to form an enclosure layer on the surface of the center core, completing the center ball.

Thread rubber was wound around the center ball by a conventional winding method to produce a wound core having an outer diameter of about 39.7 mm.

A cover stock was prepared by milling 100 parts by weight of a resin as shown in Table 1, 5 parts by weight of titanium white, and 0.3 part by weight of magnesium stearate in a twin-screw extruder. Half cups were formed from the cover stock by injection molding. The wound core was then encased in two pairs of lapped half cups which were subject to compression molding to form a two-layer cover, obtaining a wound golf ball. Note that in Comparative Examples 1 to 3, only a pair of half cups were used to form a single layer cover.

The thus produced golf balls were examined for spin, flight, and hitting feel.

The balls were actually hit with a driver (#W1) at a head speed of 50 m/sec. to measure a spin rate, carry, and total distance. The balls were also hit with a sand wedge (SW) at a head speed of 19 m/sec. to measure a spin rate.

The balls were also examined for hitting feel by a panel of three professional golfers who actually hit the balls. The ball was rated "O" for very soft feel with click, "Δ" for soft feel without click, and "X" for hard feel.

The results are shown in Table 2.

TABLE 1

| | E1 | E2 | E3 | E4 | E5 | E6 | E7 | CE1 | CE2 | CE3 | CE4 |
|---|---|---|---|---|---|---|---|---|---|---|---|
| Core | | | | | | | | | | | |
| Cis-1,4-polybutadiene | 100 | 100 | 100 | 100 | 100 | 100 | 100 | 100 | 100 | 100 | 100 |
| Zinc acrylate | 30.0 | 27.0 | 35.0 | 30.0 | 37.0 | 45.0 | 30.0 | 32.5 | 18.0 | 11.5 | 11.5 |
| Dicumyl peroxide | 1.2 | 1.2 | 1.2 | 1.2 | 1.2 | 1.2 | 1.2 | 1.2 | 1.2 | 1.2 | 1.2 |
| Antioxidant | 0.2 | 0.2 | 0.2 | 0.2 | 0.2 | 0.2 | 0.2 | 0.2 | 0.2 | 0.2 | 0.2 |
| Zinc oxide | 5 | 5 | 5 | 5 | 5 | 5 | 5 | 5 | 5 | 5 | 5 |
| Barium sulfate | 45.5 | 46.5 | 43.5 | 33.5 | 66.0 | 295.0 | 45.5 | 34.0 | 39.5 | 105.5 | 105.5 |
| Enclosure layer | | | | | | | | | | | |
| Hytrel 4047 | 100 | — | — | 100 | 70 | — | 100 | — | — | — | — |
| Hytrel 4767 | — | 100 | — | — | — | — | — | — | — | — | — |
| Hytrel 8122 | — | — | 100 | — | 30 | 100 | — | — | — | — | — |
| Cover outer layer | | | | | | | | | | | |
| Surlyn 8120 | 35 | 35 | 35 | 35 | 35 | 35 | 100 | 35 | 35 | — | 35 |
| Himilan 1650 | 65 | 65 | 65 | 65 | 65 | 65 | — | 65 | 65 | — | 65 |
| Himilan 1601 | — | — | — | — | — | — | — | — | — | 50 | — |
| Himilan 1557 | — | — | — | — | — | — | — | — | — | 50 | — |
| Cover inner layer | | | | | | | | | | | |
| Himilan 1601 | 50 | 50 | 50 | 50 | 50 | 50 | 50 | — | — | — | 50 |
| Himilan 1557 | 50 | 50 | 50 | 50 | 50 | 50 | 50 | — | — | — | 50 |

Note:
Hytrel is a trade name of thermoplastic polyester elastomers by Toray-duPont K.K., Surlyn is a trade name of ionomer resins by E. I. duPont, and Himilan is a trade name of ionomer resins by Mitsui-duPont Polychemical K.K.

TABLE 2

| | | E1 | E2 | E3 | E4 | E5 | E6 | E7 | CE1 | CE2 | CE3 | CE4 |
|---|---|---|---|---|---|---|---|---|---|---|---|---|
| Center construction | | 2 layers | 2 layers | 2 layers | 2 layers | 2 layers | 2 layers | 2 layers | 1 layer | 1 layer | 1 layer | 1 layer |
| Cover construction | | 2 layers | 2 layers | 2 layers | 2 layers | 2 layers | 2 layers | 2 layers | 1 layer | 1 layer | 1 layer | 2 layers |
| Core | diameter (mm) | 32.0 | 32.0 | 32.0 | 34.0 | 28.2 | 20.0 | 32.0 | 36.0 | 36.0 | 28.0 | 28.0 |
| | hardness* (mm) | 3.5 | 4.0 | 2.7 | 3.5 | 2.5 | 2.0 | 3.5 | 3.0 | 6.0 | 8.3 | 8.3 |
| Enclosure layer hardness (Shore D) | | 40 | 47 | 33 | 40 | 38 | 33 | 40 | — | — | — | — |
| Center diameter (mm) | | 36.0 | 36.0 | 36.0 | 36.8 | 35.5 | 33.1 | 36.0 | — | — | — | — |

TABLE 2-continued

| | | E1 | E2 | E3 | E4 | E5 | E6 | E7 | CE1 | CE2 | CE3 | CE4 |
|---|---|---|---|---|---|---|---|---|---|---|---|---|
| Cover outer layer hardness (Shore D) | | 53 | 53 | 53 | 53 | 53 | 53 | 46 | 53 | 53 | 62 | 53 |
| Cover inner layer hardness (Shore D) | | 62 | 62 | 62 | 62 | 62 | 62 | 62 | — | — | — | 62 |
| #W1 HS = 50 m/s | Spin (rpm) | 2780 | 2740 | 2840 | 2720 | 2860 | 2740 | 2790 | 2930 | 2610 | 3020 | 3130 |
| | Carry (m) | 235.0 | 235.8 | 234.8 | 235.5 | 234.6 | 235.5 | 234.5 | 233.5 | 230.1 | 233.0 | 231.7 |
| | Total distance (m) | 248.6 | 249.3 | 248.0 | 249.1 | 248.1 | 248.7 | 247.8 | 245.6 | 241.8 | 243.4 | 242.8 |
| SW HS = 19 m/s | Spin (rpm) | 5950 | 5930 | 5960 | 5940 | 5960 | 5930 | 6090 | 5960 | 5920 | 4540 | 5950 |
| Hitting feel | | ○ | ○ | ○ | ○ | ○ | ○ | ○ | x | Δ | Δ | Δ |

*Core hardness is a distortion (mm) of the core under a load of 100 kg

It is evident from the results in Table 2 that wound golf balls within the scope of the present invention provided satisfactory spin, flight distance and hitting feel. The hitting feel was excellent in that the golfer felt a soft impact with click. In contrast, a wound golf ball having a large diameter center of a relatively high hardness (Comparative Example 1) showed poor restitution because of the soft single layer cover and provided an increased spin rate, a short distance and unpleasant feel because of the hard center core. A wound golf ball having a large diameter center of a relatively low hardness (Comparative Example 2) was acknowledged to have controlled spin and improved hitting feel although it traveled only a short distance due to the lack of restitution as a result of the soft single layer cover and the soft center core. Its hitting feel was soft, but lacked click. A wound golf ball having a solid center ball of a conventional diameter (not as large as the invention) (Comparative Example 3) received a high spin rate upon driver shots, with a resultant short distance. Upon sand wedge shots, its spin rate was low, which means that the ball is not easy to control upon approach shots. A wound golf ball having a two-layer cover formed on the same core as Comparative Example 3 (Comparative Example 4) received appropriate spin upon sand wedge shots, but excess spin upon driver shots, with a resultant short distance. Its hitting feel was soft, but lacked click.

There has been described a wound golf ball which provides satisfactory spin, control and flight distance upon both driver and approach shots. Additionally, when the ball is hit, the hitting feel is soft and accompanied by click.

Although some preferred embodiments have been described, many modifications and variations may be made thereto in the light of the above teachings. It is therefore to be understood that within the scope of the appended claims, the invention may be practiced otherwise than as specifically described.

We claim:

1. A wound golf ball comprising: a center ball having thread rubber wound thereon and a cover enclosing the wound center ball, said center ball consisting of a center core having a diameter of up to 37 mm and experiencing a distortion of 1 to 5 mm under a constant load of 100 kg and an enclosing layer enclosing the center core and having a Shore D hardness of up to 54, said center ball having a diameter of 33 to 38 mm, said center core comprising a rubber composition comprising a base rubber, a co-crosslinking agent and a peroxide and being free of an oily substance, said cover consisting of an inner layer having a Shore D hardness of 55 to 68 and an outer layer having a Shore D hardness of 30 to 58, the inner layer being harder than the outer layer by at least 5 in Shore D hardness.

2. The wound golf ball of claim 1 wherein said enclosing layer has a Shore D hardness of 33 to 54 and a gage of 0.5 to 10 mm.

3. The wound golf ball of claim 1 wherein said thread rubber layer has a gage in the range of 1 to 4.0 mm.

4. The wound golf ball of claim 1 wherein said cover outer layer has a Shore D hardness of 35–55.

5. The wound golf ball of claim 1 wherein said cover outer layer has a gage in the range of 0.5 to 2.0 mm.

6. The wound golf ball of claim 1 wherein said center core has a distortion in the range of 1.8 to 4.8 mm under a constant load of 100 kg.

7. The wound golf ball of claim 1 wherein said center ball has an outer diameter in the range of 20 to 37 mm.

8. The wound golf ball of claim 1 wherein said enclosure layer has a Shore D hardness in the range of 37 to 53.

9. The wound golf ball of claim 1 wherein said enclosure layer has a gage in the range of 0.5 to 7 mm.

10. The wound golf ball of claim 1 wherein said center ball has an outer diameter in the range of 34 to 37 mm.

11. The wound golf ball of claim 1 wherein said thread rubber layer has a gage in the range of 1.5 to 3.8 mm.

12. The wound golf ball of claim 1 wherein said cover inner layer has a Shore D hardness in the range of 60 to 66.

13. The wound golf ball of claim 1 wherein the hardness of said cover inner layer is harder than the hardness of said cover outer layer by at least 8 on Shore D.

14. The wound golf ball of claim 1 wherein said cover inner layer has a gage in the range of 0.5 to 2.0 mm.

15. The wound golf ball of claim 1 wherein the gage of the cover is in the range of 1 to 3.5 mm.

16. The wound golf ball of claim 1 wherein said enclosure layer is formed from a thermoplastic resin.

* * * * *